US006732669B2

(12) United States Patent
Kames et al.

(10) Patent No.: US 6,732,669 B2
(45) Date of Patent: May 11, 2004

(54) MACHINE AND METHOD FOR CLOSING AND STITCHING FINAL EDGE OF FILLED QUILT COVER

(75) Inventors: Edward D. Kames, Skokie, IL (US); Michael V. Schwarzberger, 65 Woodlake, Gurnee, IL (US) 60031; Scott M. Will, Chicago, IL (US); Neal A. Schwarzberger, Lincolnshire, IL (US); Joseph C. Podolski, Lincolnwood, IL (US)

(73) Assignee: Michael V. Schwarzberger, Mundelein, IL (US)

( * ) Notice: Subject to any disclaimer, the term of this patent is extended or adjusted under 35 U.S.C. 154(b) by 221 days.

(21) Appl. No.: 10/083,045

(22) Filed: Feb. 26, 2002

(65) Prior Publication Data

US 2003/0159636 A1 Aug. 28, 2003

(51) Int. Cl.[7] ..... D05B 11/00; D05B 13/02

(52) U.S. Cl. ..... 112/475.06; 112/475.08; 112/470.29; 112/11

(58) Field of Search ..... 112/475.06, 475.12, 112/470.34, 475.07, 475.08, 305, 10, 11, 311, 470.28, 470.29, 470.31, 148, 147, 153

(56) References Cited

U.S. PATENT DOCUMENTS 3,527,180 A * 9/1970 Cerioni ..... 112/11
3,554,146 A * 1/1971 McClusky ..... 112/11
3,865,058 A * 2/1975 Rovin et al. ..... 112/63
5,373,977 A * 12/1994 Migliorini ..... 223/112
5,540,167 A * 7/1996 Mussig et al. ..... 112/475.09
5,588,384 A * 12/1996 Miyachi et al. ..... 112/475.06
5,979,345 A * 11/1999 Price et al. ..... 112/470.29
6,109,196 A * 8/2000 Silber ..... 112/475.08

* cited by examiner

*Primary Examiner*—Ismael Izaguirre
(74) *Attorney, Agent, or Firm*—Charles F. Lind

(57) ABSTRACT

Support members are mounted to move between two separations, respectively less than and greater than the open end of a two-panel cover otherwise seamed together around its edges. Flaps sized to define a desired closure hemm can be in-turned manually along short opposed portions of the panel ends and then positioned over the lesser spaced support members to mount the cover thereon. The support members when at the greater separation will tension the open panel edges and extend the flaps accurately in-folded between the support members. The support members can have a first size defining a large edge opening for receiving a nozzle suited for blowing unwanted materials from between the flaps, and a smaller size for minimally gapping the flaps. A sewing machine can then automatically stitch through the panels and hidden flaps, for closing the cover end edge. Clamps can grip spaced cover locations for added cover support.

18 Claims, 8 Drawing Sheets

MACHINE AND METHOD FOR CLOSING AND STITCHING FINAL EDGE OF FILLED QUILT COVER

BACKGROUND OF THE INVENTION

A bed quilt 8 (see FIGS. 1–5) is commonly comprised of a mat of batting 10 or insulating fill material sandwiched between top and bottom fabric panels 11*t*, 11*b* that are stitched together by peripheral seams along the four edges (head seam 13*h*, foot seam 13*f* and two side seams 13*s*), and by pattern seams 14 across the panels (and batting) inwardly of the peripheral seams. Most quilts are rectangular in shape, having the side seams 13*s* substantially parallel to one another and having the head and foot seams 13*h*, 13*f* substantially parallel to one another and substantially perpendicular to the side seams.

In forming the quilt, the panels 11*t*, 11*b* initially are laid with the outside faces against one another and are stitched together inside-out around three adjacent edge seams (see FIG. 3, typically the two side seams 13*s* and the foot seam 13*f*). This defines a three-sided bag "B" having the fourth head edge 12 open. A fill machine 16, commonly used to fill the bag, would have a tubular horn 15 elongated to almost the inside width of the open bag and a ram 17 sized to fit through the horn and completely into the bag. Two operators (not shown), standing on opposite ends of the horn would together fit the open bag onto the horn 15, bunching up thereon the yet inside-out panels until the foot seam 13*f* is aligned over an inlet opening of the horn. The ram 17 with batting 10 lying thereon would then be advanced against the stitched edge seam 13*f* and through the horn, operable to unfurl the panels 11*t*, 11*b* through the horn and draw them right-side out and around the batting 10. After the ram 17 is withdrawn, the now filled bag "B" is lying flat on the fill machine table 18 with the final or fourth edge 12 open toward and somewhat proximate the horn outlet opening.

The final or open fourth bag edge 12 would then have to be stitched closed along the seam 13*h*. Heretofore, a skilled operator had to complete such stitching using a sewing machine, but this procedure has proved to be difficult and costly. For example, (1) the filled bag "B" had to be manually transferred to the sewing machine operator; who (2) then manually had to fold the separate end edges of the open bag panels inwardly along straight corners 20 as short flaps 21, and (3) had to position the flaps flush against one another, with the flap corners lined up straight and even to define what many call a French Hemm flap configuration; but (4) the operator, starting at one side edge seam 13*s*, would have to repeatedly fold and stitch only short lengths of the panel edges at a time, progressively folding additional lengths of the panel flaps 21 (possibly 5–10 inches at a time and just before being stitched at the sewing machine; and (5) all the while trying to keep the closure seam 13*h* uniform and straight for yielding an acceptable guilt.

OBJECTS AND SUMMARY OF THE INVENTION

An object of this invention is to provide a machine and method for closing and stitching closed, in an in-folded flap configuration, the final open or fourth edge of a filled quilt bag or cover, virtually automatically once the bag fill machine operators have transferred the opened bag edge onto the machine.

A more specific object of this invention is to provide a machine and method for accurately forming an in-folded flap configuration or hemm simultaneously along the entire length of the final open bag edge, by: folding the in-folded flaps along only a short length of the open bag edge across and inwardly from each of the bag side seams, positioning the in-folded flaps over respective spaced separator members with the side seams overlying the separator members, and moving the separator members apart until the bag edges are drawn tight causing said folded flaps to be extended over the remaining intermediate portions of the bag edge, continuously between adjacent side seams of the bag.

A further object of this invention is to provide a machine and method for moving such folded but yet opened bag edge into operative association with an automatic sewing machine, and for moving the bag and sewing machine relative to one another along the final opened bag edges for first clearing away exposed fill or batting material and then for stitching the opened edges closed, all without operator assistance.

BRIEF DESCRIPTION OF THE DRAWINGS

FIG. 5 showing the fourth edge stitched closed;

DETAILED DESCRIPTION OF THE INVENTION

Figure 7:
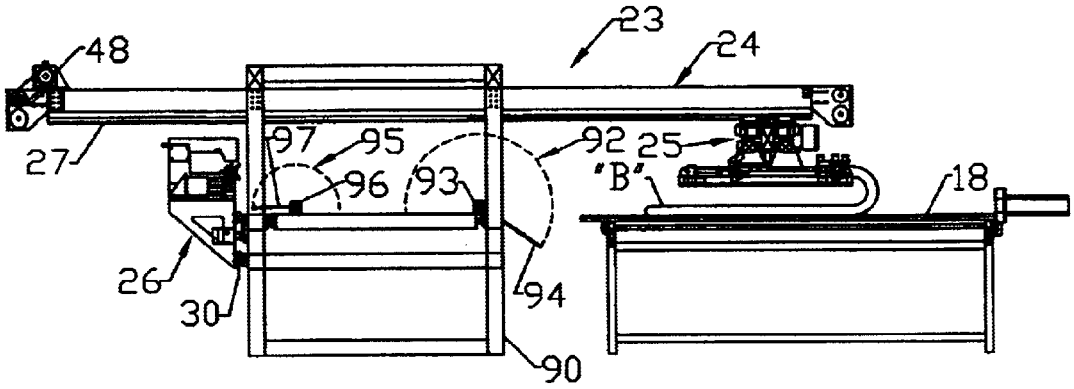
FIG. 7 is a side elevational view of the inventive machine operatively overlying the fill machine table and extending to be operatively proximate the sewing machine.
Figure 8:
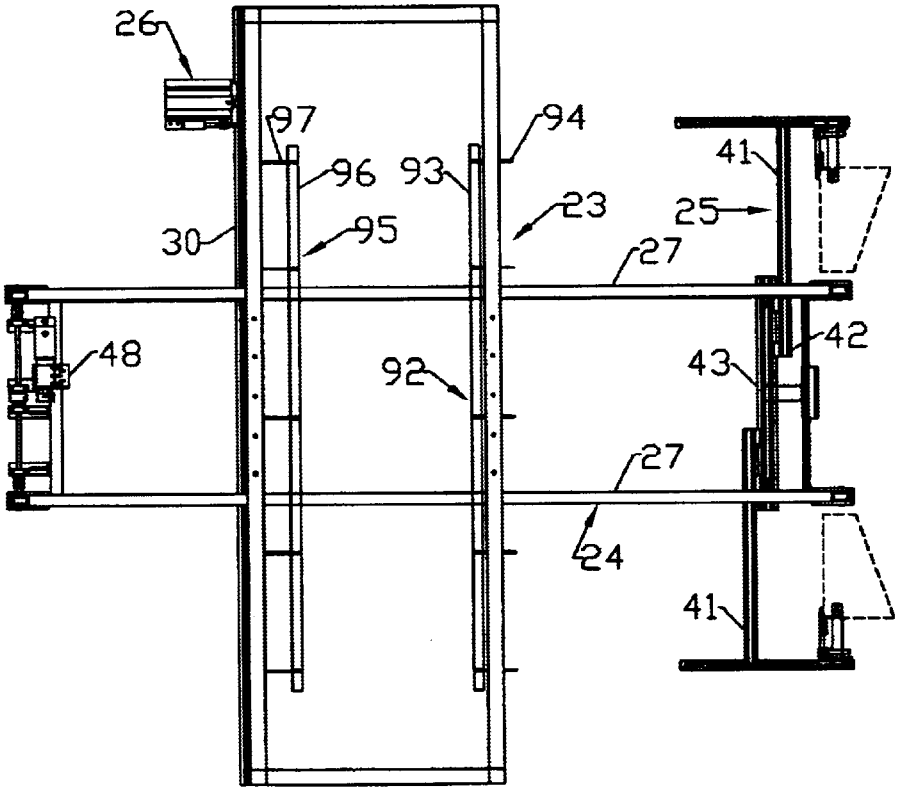
FIG. 8 is top view of the machine of FIG. 7.

The illustrated machine 23 (see FIGS. 7, 8) has a frame 24 that supports and accommodates the different reciprocating movements of transfer mechanism 25 and automatic sewing machine 26. Thus, frame beams 27 via bearing/guide means 28, central beam 43 and linear actuator 48 provide for movement of the transfer mechanism 25 between a quilt bag loading position (in FIGS. 7, 8, 10) overlying the fill machine table 18 (where a filled but open quilt bag "B" ready for closing would lay) and a stitching position operatively proximate the sewing machine 26. Frame beams 29 support via bearing guide means 30 the sewing machine platform 31 for sewing machine movement for stitching the bag closing seam 13*h*. The frame beams 27, 29 lie transverse or even normal to one another, so that the transfer mechanism and sewing machine will move in like manner relative to one another.

The transfer mechanism 25 (see FIGS. 10, 11, 12A, 12B, 13A, 13B) includes a clamp and stretch assembly 32 comprised of spaced pairs of support arms 33 and separator members 34, 35; spaced pairs of clamp ledges 36 and arms 37 closed by actuators 38 moving the clamp arms about axes 39; and telescoping cross bars 40 spanning the width of the assembly. The assembly 32 is carried near its opposite ends to the opposite ends of separate cross beams 41 (FIGS. 8, 10), that via bearing guide means 42 are supported by and can be telescoped relative to the central beam 43. Gearmotors 45, carried on central beam 43 and via output rotation of drive pinions 46 enraging racks 47 mounted on the respective beams 41, can shift the separator members 34, 35 to different lateral separations.

Figure 10:
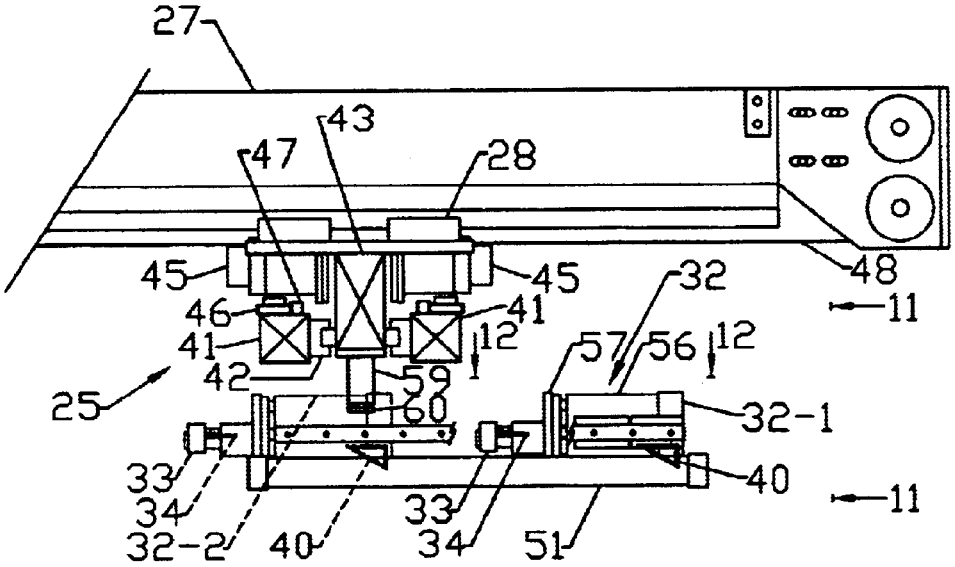
FIG. 10 is an enlarged side elevational view of part of the machine illustrated in FIG. 7.
Figure 11:
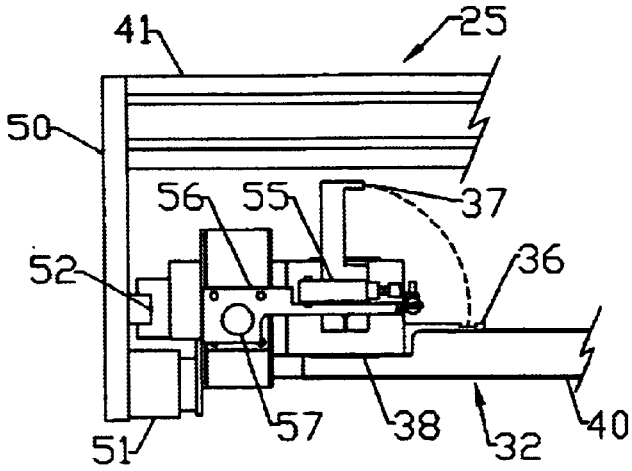
FIG. 11 is an elevational view of the left quilt bag gripping assembly, as seen generally from line 11—11 in FIG. 10, except showing the clamp arm opened.

Panels 50 (FIG. 11) on the remote ends of respective lateral beams 41 support linear drive actuators 51, which in turn via guides 52 support the assembly 32 to move between positions 32-1 (in solid) and 32-2 (in phantom) in FIG. 10. In position 32-2 (see FIG. 14A), the assembly 32 is close to the sewing machine 26 suited for stitching the quilt.; but the small clearance between the assembly and overlying beams hinders the operators in reaching the separator members 34, 35 for loading the quilt bag thereon (as will be noted). However, with the assembly 32 in position 32-1 (and when overlying the table 18, FIG. 7), the separator members 34, 35 are laterally clear of the beams 41 yielding better accessibility for easy operator loading of the quilt bag onto the transfer mechanism 32.

Each separator member 34 can be in the form of a cylindrical pin several inches long (or slightly longer than the width of the folded flap 21) and a small cross section of ¼ inch or less, the pin being fixed to and cantilevered from arm 33 to point away from sewing machine 26. Each separator member 35 can also be a cylindrical pin (of related or shorter length than pin 34) but of larger cross section between ½ inch, and 1 and ½ inch. However, the pins 35 are pivoted inwardly adjacent the fixed pins 34 to swing around respective axes 54 disposed normal to a plane extended centrally through the spaced pins 35. An actuator 55 powers each pin 35 between an operative orientation (FIG. 12A) generally parallel to the pin 34 and pointing away from the sewing machine 26, and an inoperative orientation (see FIG. 12B) pointing transverse to the pin 34 and inwardly toward the other pin 35. The fixed pins 34 extend substantially parallel to one another and normal to the beams 41.

A power thruster 56, having a drive rod 57 supporting the separator arm 33, is further provided adjacent each end of the assembly 32 operable to move the separator pins 34, 35 between the illustrated spacing from the edge clamps 36, 37 (for quilt loading and sewing), and an inoperative position (not shown) where the pins are at a greater pin/clamp spacing so as to thereby axially withdraw the pins 34 from the yet clamped quilt bag "B", at the end of the sewing cycle to be noted later herein.

Figure 1:
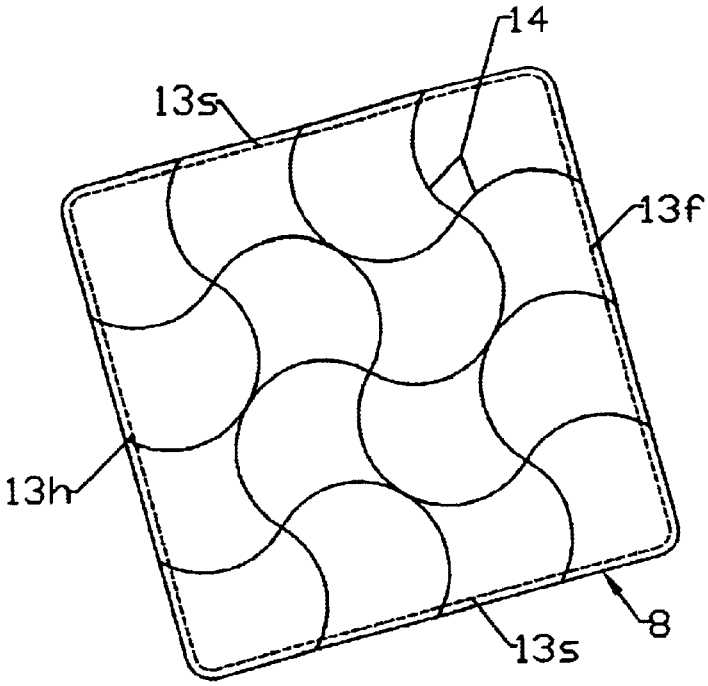
FIG. 1 is a perspective view of a finished quilt.
Figure 2:
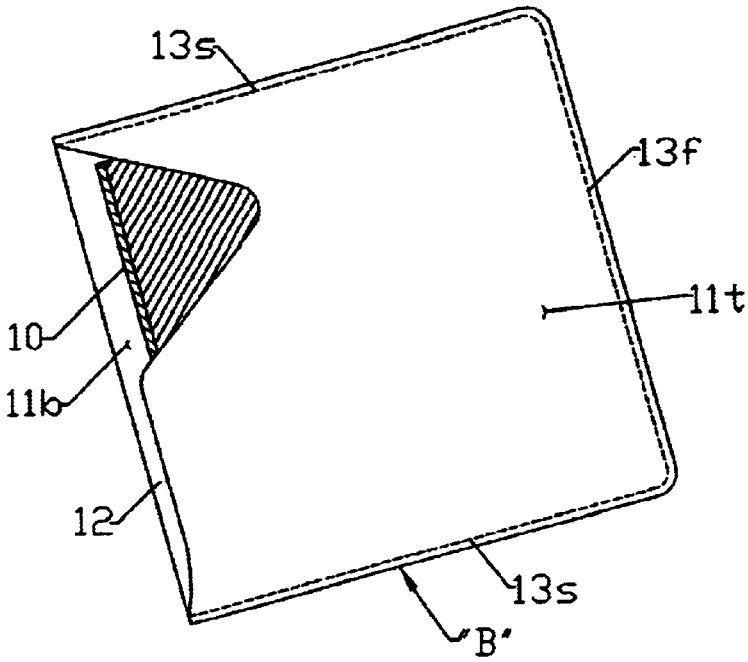
FIG. 2 is a perspective view of a filled quilt bag or cover yet having its fourth edge open and unstitched.
Figure 3:
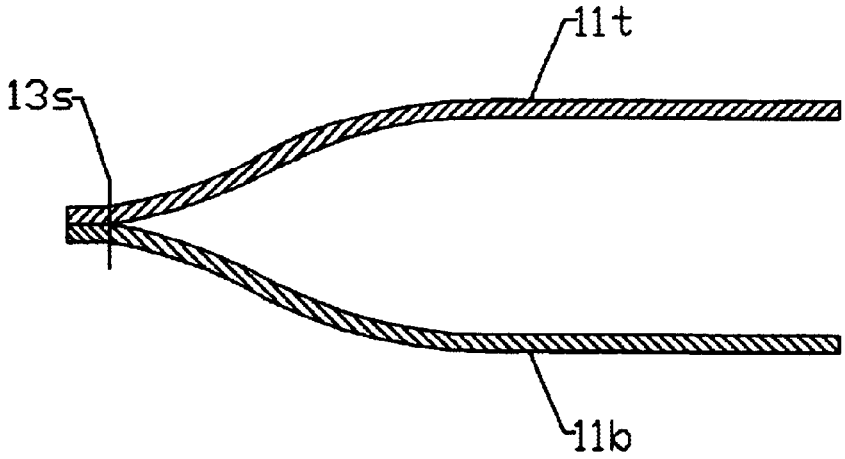
FIG. 3 is a sectional view of stitched quilt bag panels when inside-out and before being filled with the batting.
Figure 4:
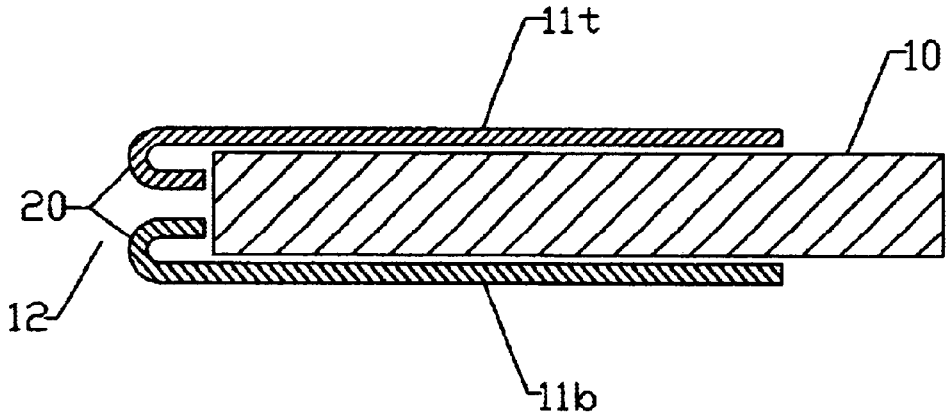
FIGS. 4 and 5 are enlarged sectional views of the fourth edge of a filled quilt bag, FIG. 4 showing the fourth edge folded in the French Hemm configuration, but unstitched.
Figure 5:
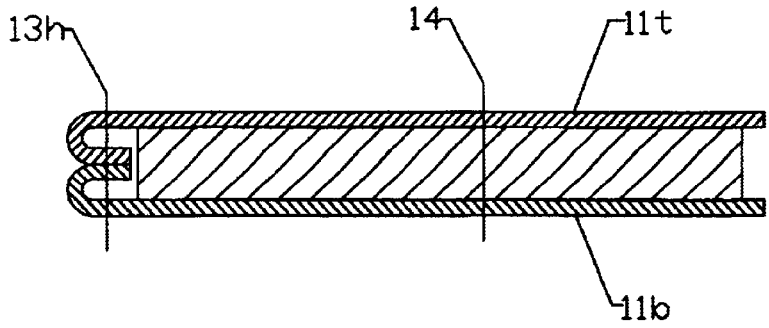
Figure 6:
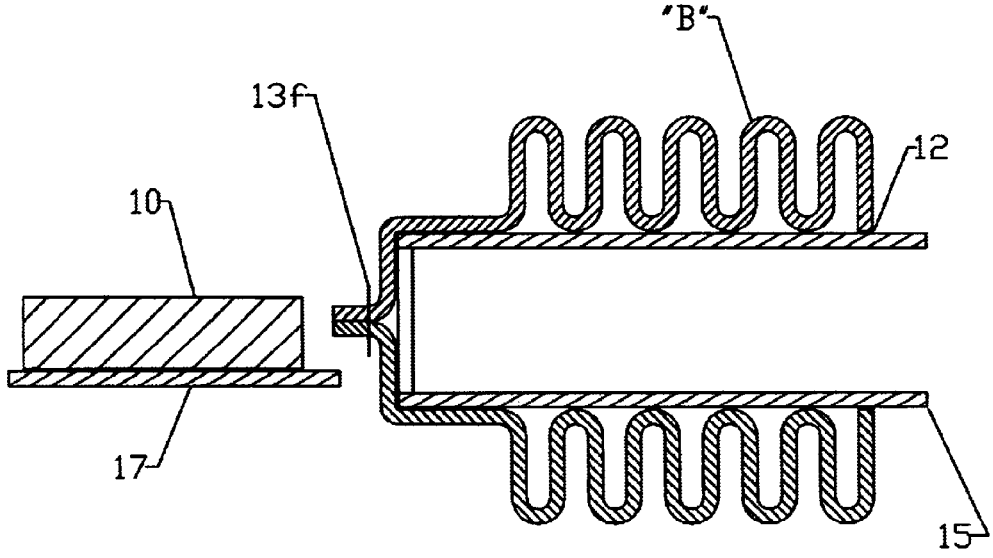
FIG. 6 is a sectional view of the fill machine horn with the inside-out stitched quilt panels bunched up thereon, and with the machine ram and a mat of fill batting thereon each positioned for movement against the panels and passage through the horn.

The parallel pins 34, 35 might be separated by perhaps 3–6 inches less than the inside of the final quilt bag opening, for easy but yet accurate operator bag loading on the pins. The two fill machine operators (not shown but acting as a team and standing on opposite sides of the table 18) could thus accurately fold along both the upper and lower panel corners 20 (see FIGS. 4, 5) in-folded flaps 21 extended between ½ and 1 inch in from the panel corners 20 (known to many as the French Hemm). The flaps 21 would extend across the intervening bag side seam 13*s* and along both bag panel edges from the seam by only a few inches. The operators might then: orient the bag opening to open toward the sewing machine 26 (rotated one half turn from when on the table 18); pass the gripped folded bag edge over the cross bar 40; and position the opened and folded bag edges onto the nearby separator pins 34, 35, with the fold corners 20 against the arm 33 and with each side seam generally parallel to and overlying its pin members 34, 35 (see FIG. 13A).

Each operator further can then make sure that the trailing bag side edge overlies the adjacent clamp ledge 36, and when the bag is positioned accurately, can activate the clamp actuator 38 to swing the clamp arm 37 about axes 39 and against clamp ledge 36 to hold the quilt bag therebetween as positioned. Each clamp actuator 38 can be independently activated by each operator upon depressing a nearby clamp control element (not shown), or can be activated together but only after both operators have triggered both respective clamp control elements within a short duration of one another (such as within 2–5 seconds).

Figure 13A:
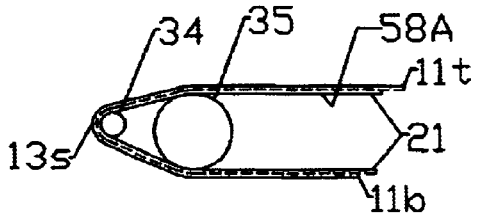
FIGS. 13A and 13B are enlarged elevational views showing the guilt bag panel edges having in-folded flaps lying against and drawn tightly over the separator members, as in the operative positions of FIGS. 12A and 12B respectively.
Figure 13B:
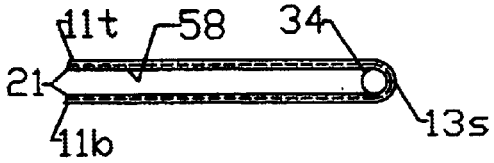

After the quilt bag "B" has been accurately located on the separator pins 34, 35 and the clamps 36, 37 have been closed to hold the bag sides, one or both of the gearmotors 45 can be activated to shift the pins 34, 35 apart to a greater sewing separation. This will draw the final open bag edges tightly around both separator members 34, 35 (see FIG. 13A) which effectively will hold the accurately in-folded flaps 21 thereon and will flip over the unsupported intermediate bag end edges between support on the large pins 35 to define accurately in-folded flaps extended completely across the span between these pins. The tightly drawn bag edges further will extend substantially straight across the span tangent to the pins 35 to define the bag opening 58A (FIG. 13A). After the pins 34, 35 have been separated as desired, the beams 41, 43 can be locked in place such as by braking the gearmotors 45, to keep this pin separation.

The stretching separation of separator Pins 34, 35 might be the same as or up to several inches more than the nominal full quilt width. However, as different quilt fabrics stretch differently, some experimentation might be needed for determining a preferred stretching separation for each construction, type, size of quilt bag to be stitched closed. Conventional means, such as linear encoders (not shown), can be associated with the separator pins to accurately control the gearmotors 45 to obtain any desired separation. Further, an alternative or supplemental separation control might be used, such as a force sensor (not shown) operatively associated with the powered separating gearmotor means 45 that would terminate the separation when a desired tensile force has been reached.

This method of folding the quilt flaps 21 between separating support pins 34, 45 is fast and easy, and accurate to the end that the developed flaps should line up substantially opposite one another and the fold corners 20 should be straight, over the entire span between the pin supports.

With the beams 41, 43 locked in place, the clamp and stretch assembly 32, by drive actuator 51, could be shifted from the loading position 32-1 to the stitching position 32-2 (FIG. 10) where the cross bar 40 underlies the central beam 43. One or more power cylinders 59 are carried on the central beam 43, and when actuated will shift respective ram carried clamps 60 against the underlying bar 38, and the intermediate parts of the quilt bag therebetween. This would securely hold the stretched open bag end, with accurately the folded flaps 20 extended entirely across its unstitched edges, for transfer to the sewing machine.

Figure 14A:
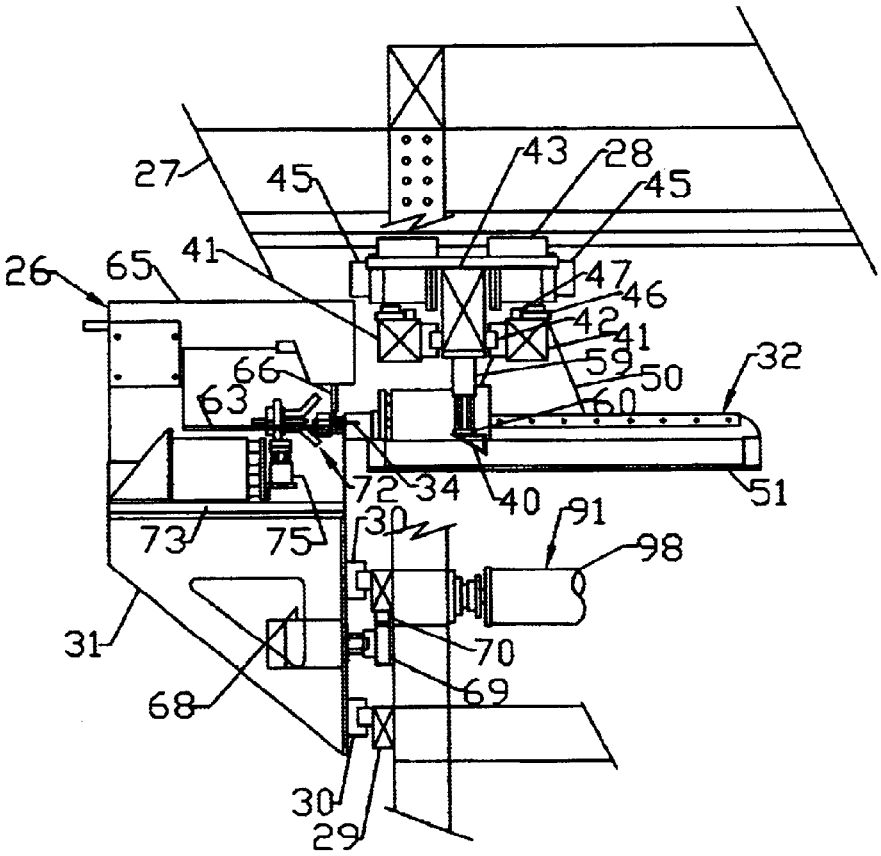
FIG. 14A is an enlarged elevational view of part of the machine of FIG. 7, except having the transfer mechanism shifted to be in operative association with the sewing machine, and showing the guilt bag guide retracted from operative association with the quilt bag held on the transfer mechanism.
Figure 14B:
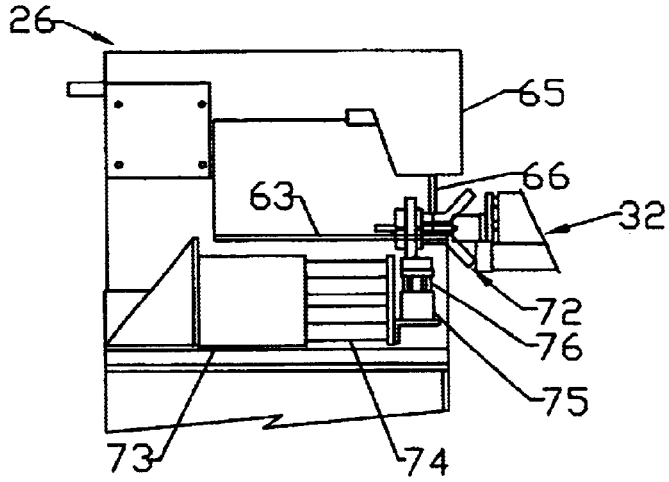
FIG. 14B is an elevational similar to FIG. 14A, except having the guilt bag guide shifted to be in operative association with the quilt bag held on the transfer mechanism.

The sewing machine 26 (FIGS. 14A, 14B, 16) can be conventional, having a base 63 (and underlying bobbin needle, not shown), an overlying sew head 65 and powered thread needle 66. The open quilt edges to be stitched would ride over the base 63 and under a pressure foot (not shown), past the reciprocating needles. The illustrated arrangement provides for the quilt bag to be stationary and the sewing machine 26 via its supporting platform 31 to be moved laterally along frame beams 29, powered by motor 68 (on the platform) and its driven pinion 69 engaging and rolling along rack 70 held on one of the beams. The arranged sewing machine base 63 will be aligned to be slightly below (by possibly ⅛ inch) the tangent plane spanning between the lower sides of the spaced separator pins 34, 35 (FIG. 14A).

Figure 15:
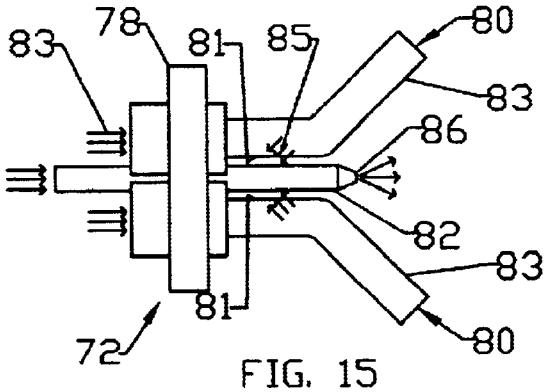
FIG. 15 is an enlarged elevational view of the quilt bag guide of FIG. 14B, shown in operative association with the quilt bag illustrated in phantom.

A quilt edge guide 72 (FIGS. 14A, 14B, 15) is also carried on the sewing machine platform 31, spaced a small lateral distance (possibly several inches) upstream from or ahead of needle 66 (FIG. 16), referenced according to movement of the sewing machine during stitching. The guide 72 is carried by independently operated power actuators 73, 75, to be moved either generally toward and away from and/or transverse to the bag opening. Actuator 73 carried on the platform 31 thus powers a guided ram 74 and power actuator 75 carried thereon generally toward and away from the bag opening; and actuator 75 powers a guided ram 76 and quilt guide 72 carried thereon transverse to the elongation of the bag opening or to the top and bottom side tangent planes off of the separated support pins.

The quilt guide 72 includes a base 78 and three fingers 80, 82 projected therefrom. The upper and lower fingers 80 project generally normal to the base 78 initially and then diverge apart like at 83, and the intermediate finger 82 projects generally normal to the base evenly spaced between the fingers 80. Thus, upper and lower channels 81 are defined between the spaced fingers 80, 82, the channels being sized to receive (somewhat snugly) the respective upper and lower folded bag edges that are to be stitched together. The guide fingers lie generally within a single plane that, when the guide is operatively mounted on the machine, extends generally normal to the elongated bag opening.

The fingers 80, 82 are hollow, with base connections 83 for delivering via conventional lines (not shown) air under pressure to the finger interiors. The fingers 80 have side outlet openings 85 to direct air into the adjacent channels 81 angled about 40–50 degrees back toward the base 78, and finger 82 has end outlet opening 86 to direct air forwardly away from the base, just beyond where the fingers 80 diverge. The fingers can be formed of rigid cylindrical tubing possibly between ¼ and ¾ inch outer diameters.

The air discharge jets from the upper and lower fingers 80 tend to bias the respective bag panels 11*t*, 11*b* into the channels 81 and hold them against the base, while the air discharge from the intermediate finger 82 is directed as jets against nearby batting 10 between the bag panels 11*t*, 11*b* to move such inwardly between the panels and clear of the bag edges, leaving the edges to be stitched together without any exposed batting that could for quality purposes require costly trimming to remove.

The sewing machine 23 could have a lateral start position, where: (1) the needle 66 and quilt guide 72 are between the spaced pair of separator pins 34, 35 and closely adjacent one set of pins 34, 35, but adjacent the one set of pins 34 that will be on the opposite side of the sewing machine needle 66 from the quilt guide 72; (2) the quilt guide as shifted by actuator 75 will have its intermediate finger 82 aligned generally along a central plane through the large separator pins 35, which central plane will be spaced above the sewing machine base 63; (3) the upper and lower diverging guide finger 80 will be projected forwardly beyond the front edge of the sewing machine base 63 and transversely above and below the respective stretched upper and lower quilt panels; and (4) the quilt guide as shifted by actuator 73 will have the guide channels 81 extended past the plane of needle movement during stitching.

Figure 12A:
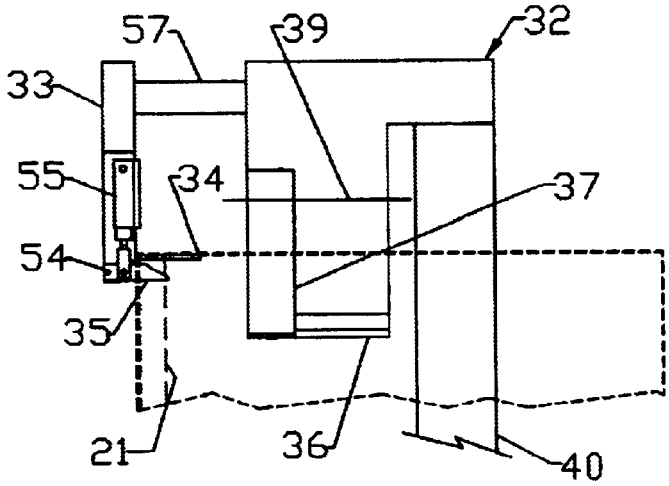
FIG. 12A is a top view of the quilt bag gripping assembly, such as might be seen generally from line 12—12 in FIG. 10, showing the adjacent separator members positioned operatively parallel and the clamp closed.
Figure 12B:
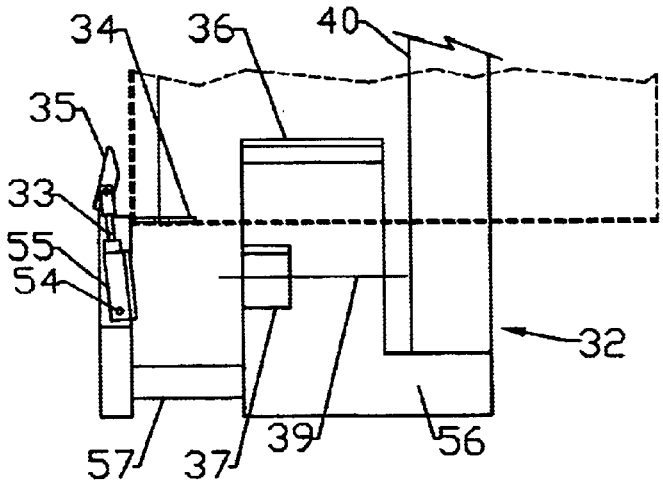
FIG. 12B is a top view of the left side quilt bag gripping assembly, except showing only the small separator member in the operative position and the clamp opened.

Thus, as the transfer mechanism 25 (and stretched opened and folded quilt bag "B" held thereon) is moved by actuator 48 to the sewing position (FIGS. 14A, 14B), the intermediate guide finger 82 will fit quite accurately into the large bag opening 58A while the outer fingers 80 overlap and direct the respective folded bag panels into the channels 81 so that the flap corners 20 can butt against the pin arms 33. After the quilt guide 72 has vertical control of the bag via the bag panels being contained in the channels 81, the large separator pins 35 will be shifted by actuator 55 to the inoperative positions (FIG. 12B). This provides open bag edge support (FIG. 13B) only on the smaller pins 34, so that the upper and lower panel edges move closer together to reduce the baa opening 58B size. The guide 72 will then be lowered (by actuator 75) to present the channels 81 even with or slightly below the base 63, to draw the folded quilt bag edges to be stitched more tightly and/or evenly against the base for yielding more reliable stitching.

Figure 9A:
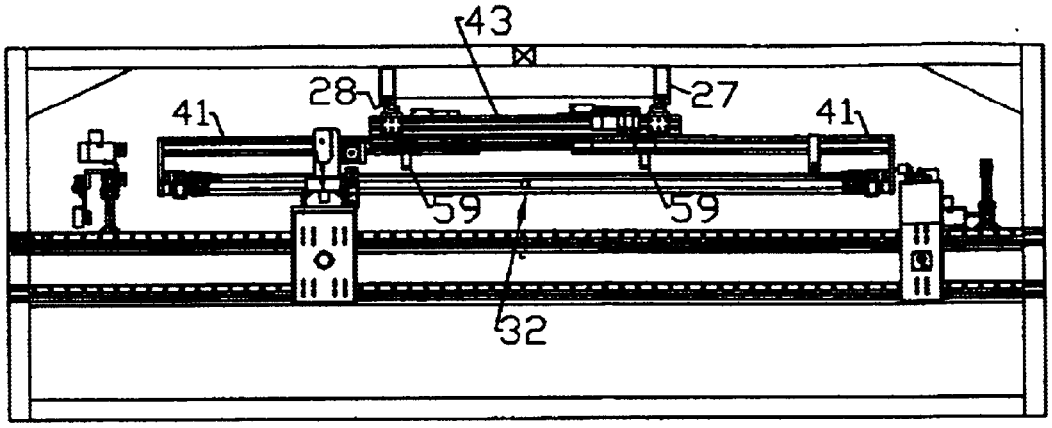
FIGS. 9A and 9B are elevational views of the machine as seen from the right in FIG. 7, except without the fill machine table, and further with the machine being set in FIG. 9A to accommodate a large quilt and FIG. 9B to accommodate a smaller quilt.
Figure 9B:
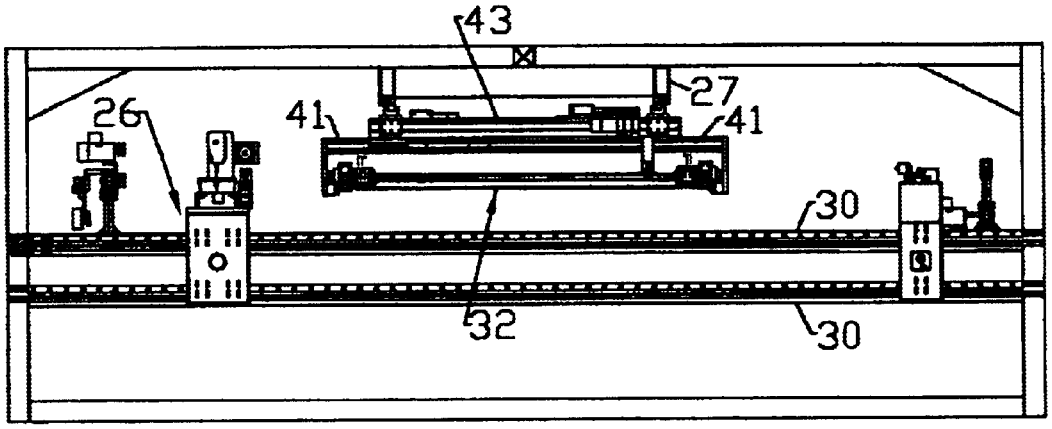
Figure 16:
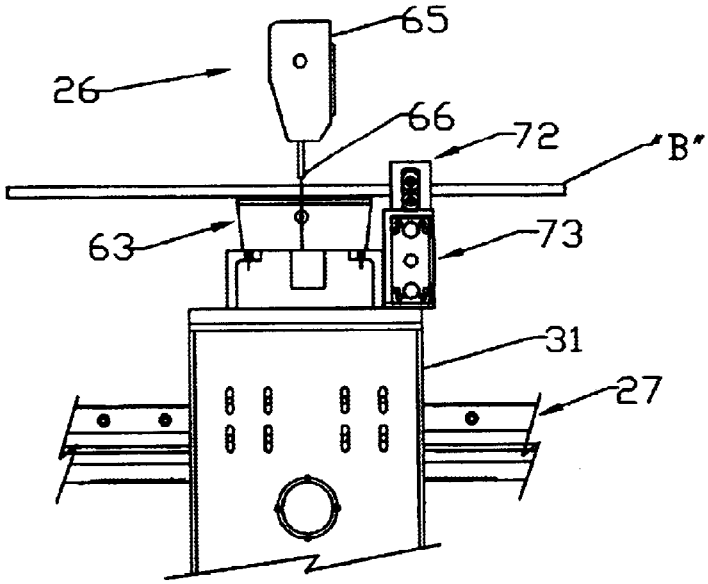
FIG. 16 is an enlarged elevational view of the quilt bag guide shown in operative association with the sewing machine, with the quilt bag illustrated in phantom.

The sewing machine will traverse the quilt edges for stitching them, moving so that the quilt guide 72 will be ahead of the sewing needle 66 (left to right in FIGS. 9A, 9B, and right to left in FIG. 16). To achieve accurate spacing of the stitched seam from or parallel to the panel edges, an optical scanner (not shown) having a receiver located in the base 63 and a sender in the sew head 65 can sense the moving bag edge and its spacing from the needle 66 or stitched seam, and respond to sensed excessive variances from a desired set distance (¼ inch for example) to active the actuator 48 and shift the sewing machine in a counter acting manner so as to maintain the desired seam/edge spacing.

During stitching, the initial sewing machine movement can be toward the adjacent side seam 13*s* to back tack over several inches the bag edge up to close proximity (possibly within ⅛ inch) of the small support pin 34 (without striking the pin), whereupon the sewing machine movement can be reversed to stitch the closure seam in the direction toward the other support pin 34 until the seam is almost across the full width of the accurately folded bag opening. Just before the quilt guide 72 reaches the other pin 34 (perhaps yet 4–10 inches away), the guide actuator 73 can be activated to shift the guide 72 to its retracted position (FIG. 14A) clear of the path of the sewing machine so that seam stitching can continue up to an appropriate safe needle/pin gap (again possibly within ⅛ inch). The sewing machine movement can then be reversed to stitch a back tack at this opposite seam end. The seam thread can be trimmed as needed, and the sewing machine then can be moved back to the start position ready for stitching a subsequent quilt bag.

When the final edge seam (including back tacks at both ends) has been completed, the power thruster 56 will be activated to shift the support arm 33 and pins 34 axially away from the adjacent clamps 36, 37 and 40, 60, for withdrawing the pins 34 from the yet clamped but now stitched quilt bag. The clamp actuators sequentially can be activated then to open the clamps 36, 37 and 40, 60 to release the quilt bag, for manual or automatic removal from the machine 23, as will now be noted.

It will be appreciated that as the transfer mechanism 25 is initially moved from the table 18 to the sewing machine 26 (FIGS. 7, 8), the lead portion of the quilt bag held thereon will be shifted right up to the sewing machine. On the other hand, only its mid portion will for sure also be moved over a frame beam 90 to a space between the frame beams 30, 90. If the beams 30, 90 are spaced between 3–5 feet apart, means 91 can be provided between the beams 30, 90 to support the quilt mid portion before, during and after seam stitching. Further, rotary product folders 92, 95 can be mounted on the frame adjacent its opposite entry beam 90 and the sewing machine beam 30, operable to fold the trailing and leading quilt bag ends inwardly toward and onto the quilt mid portion on the support 91.

The folders 92, 95 might respectively have shafts 93, 96 and spaced fold arms 94, 97 radially projected therefrom and underlying the respective trailing and leading quilt bag portions, and means (not shown) to support and rotate the shafts and arms. The folders further might extend to near side edges of the widest quilt bag to be stitched on the machine 23. Thus, the trailing folder 92 can rotate its arms 94 counterclockwise (see FIG. 7) to fold the trailing quilt bag end onto the quilt bag mid portion already on the surface 91; and after the clamps have released the lead now stitched end of the quilt bag, the lead folder 95 can rotate its arms clockwise (see FIG. 7) to fold the stitched quilt end portion onto the mid and trailing quilt portions supported on the surface 91. The surface 91 can be slightly lower than sewing machine base 63, to ease the effort needed in folding the released quilt bag lead portion.

One preferred surface 91 can be a moveable belt of an automatic powered belt conveyor 98 suited for removing the stitched quilt bag away from the sewing machine. The conveyor might further operate to convey the stitched quilt bag directly to a subsequent handling station (not shown and which forms no part of this invention) that might be used as part of the quilt fabrication. The cleared sewing machine also will be ready for stitching a subsequent quilt.

Of great importance, the disclosed edge closure machine 23 stitches the final open edge of a quilt bag accurately and consistently; and without operator intervention after having the filled quilt bag loaded onto the machine's transfer mechanism initially. The illustrated and preferred embodiment has the closure machine paired with a fill machine, to be loaded by the same two operators generally used with the fill machine. However, its advantages would allow closure and stitching of filled but open quilt bag retrieved from a hopper of like bags and individually loaded on the machine by one or more unskilled operators (not shown). Machines as disclosed herein have closed and stitched successive quilt bags on complete cycle times as fast as 25–40 seconds.

While specific structures have been disclosed, it is apparent that variations can be made therefrom, or the structures might even be eliminated completely, while yet having an operable and advantageous invention. For example, the clamp and stretch assembly 32 illustrated had transfer structures 51 for moving the assembly between two positions 32-1 and 32-2; but such structures and movement only provide for greater clearances for easing the efforts needed for the operators to load the quilt bag onto the separator pins 34, 35. However, the position 32-1 and its related structures could be eliminated entirely. The invention thus is not to be limited to its disclosure, but only by the scope of the following claims.

What is claimed as our invention is:

1. A method of closing an edge opening of a cover having adjacent panels secured together along spaced side edge seams, comprising the steps of in-folding the panels respectively across and adjacent both of the side seams at the edge opening as flaps respectively overlying the side seams and extended therefrom only a small percent of the distance to the opposite side seam along the edge opening;

positioning the folded cover panels and in-folded flaps around support members held at a first separation slightly less than the edge opening, with the in-folded flaps generally at the side seams overlying and against the support members;

separating the support members to a second separation greater than the first separation to tension the cover panels adjacent the edge opening, thereby causing the in-folded flaps overlapping the support members and on the immediately adjacent panel edges to be extended across the entire edge opening and substantially between the side seams; and stitching with an automatic sewing machine said cover panels and underlying in-folded flaps together for closing the edge opening as a final seam extended along and substantially between the side seams.

2. A method according to claim 1 of stitching closed with in-folded flaps an open cover edge, comprising the further steps of changing the cross-sections of the support members between first and second sizes when the support members are at the second separation with the cover panel edges tensioned, the first size spacing the flaps apart by as much as the first cross-section across the edge opening and the smaller second size spacing the flaps apart minimally for allowing flap contact even between the support members when the final seam is stitched along the panels and flaps.

3. A method according to claim 2 of stitching closed with in-folded flaps an open cover edge, comprising the further steps of positioning outer guide fingers snugly against the cover panels opposite the in-folded flaps, suited for holding the flaps and panel overlapped and closely adjacent one another prior to the final seam being stitched along the panels and flaps.

4. A method according to claim 2 of stitching closed with in-folded flaps an open cover edge, comprising the further steps of inserting a guide finger between the in-folded flaps of the edge opening when said flaps are suspended between the larger first size support members, and discharging a gas from the guide finger for blowing batting material or like foreign material from between the in-folded flaps and panels before they are stitched as the final seam to reduce possible material exposure after completing the final seam.

5. A method according to claim 2 of stitching closed with in-folded flaps an open cover edge, comprising the further steps of positioning outer guide fingers snugly against the cover panels opposite the in-folded flaps and inserting an intermediate guide finger between the in-folded flaps of the edge opening when said flaps are suspended between the larger first size support members, suited for holding the respective in-folded flaps and panel closely adjacent one another prior to the final seam being stitched.

6. A method according to claim 5 of stitching closed with in-folded flaps an open cover edge, comprising the further steps of advancing the guide fingers and operating sewing machine, with the guide finger upstream of the sewing machine, simultaneously in unison relative to and along the folded and tensioned panel edges, and of shifting the guide fingers transverse to the tensioned panel edges to align them substantially with or slightly below the sewing machine base prior to stitching.

7. A method according to claim 5 of stitching closed with in-folded flaps an open cover edge, comprising the further steps of advancing the guide fingers and operating sewing machine, with the guide finger upstream of the sewing machine, simultaneously in unison relative to and along folded and tensioned panel edges at the edge opening while simultaneously discharging a gas from the intermediate guide finger for blowing away upstream of the stitching batting material or like foreign material between the in-folded flaps and panels before stitching them as the final seam to reduce possible material exposure after completing the final seam.

8. A method according to claim 6 of stitching closed with in-folded flaps an open cover edge, comprising the further step of removing the support members from between the cover panels just prior to the sewing machine completing the final seam.

9. Apparatus for closing and seaming an edge opening of a cover having adjacent panels secured together along spaced side edge seams, comprising the combination of a sewing machine operable for stitching;

a transfer mechanism including spaced cover support members, and means to move the support members toward and away from one another between first and second separations;

said first separation of the support members being less than the spacing between the cover side seams allowing the cover panels to be positioned thereover, with in-turned flaps across the side seams and with the side seams generally overlying the respective spaced support members, and said second separation of the support members being substantially the same as or slightly greater than the spacing between the cover side seams thereby tensioning the separate cover panels and causing the flaps then to be extended substantially between the side seams and to define an elongated cover edge opening; and means for moving the sewing machine and tensioned cover edge opening operatively together and for stitching the final seam along the cover edge and in-folded flaps.

10. Apparatus according to claim 9 for closing and seaming an edge opening of a cover, further comprising clamps mounted to grip the cover at locations remotely of the support members and cover opening edges; and means for shifting the clamps to closed positions gripping and supporting the cover even when dangling, and to opened positions releasing the clamped cover panels or for receiving a cover to be clamped.

11. Apparatus according to claim 9 for closing and seaming an edge opening of a cover, further comprising the support members being shifted between first and second cross-section sizes when the support members are at the second separation with the cover panel edges tensioned, the first size support members spacing the tensioned flaps apart for making the edge opening visually apparent and suited to receive a secondary member and the smaller second size support members spacing the flaps apart minimally for allowing contact of flaps spanning the support members for stitching the final seam along the panels and flaps.

12. Apparatus according to claim 11 for closing and seaming an edge opening of a cover, further comprising said support members being separate first and second pairs of pins of said first and second respective support member sizes, the second pair of pins being fixed and disposed outwardly adjacent the first pair of pins, and means for supporting the first pair of pins to move between being substantially parallel to the second pair of pins and being transverse to and spaced clear of the first pair of pins.

13. Apparatus according to claim 9 for closing and seaming an edge opening of a cover, further comprising a guide having outer fingers angled apart to a separation greater than the first cross-section suited to exceed the cover panels at the edge opening, and said outer fingers being extended to a narrowed separation and then extending substantially parallel to one another defining channels suited to contain and hold the panels and in-folder flaps generally snugged together suited for being stitched together along the final seam, and means holding the guide relative to the sewing machine.

14. Apparatus according to claim 11 for closing and seaming an edge opening of a cover, further comprising a guide having a finger suited to fit into the visually apparent edge opening between the cover panel edges and in-turned flaps as tensioned by the first size support members, and means for discharging a gas from the free end of the guide finger for blowing batting material or like foreign material from between the in-folded flaps and panels before they are stitched as the final seam to reduce possible material exposure after completing the final seam, and means holding the guide relative to the sewing machine.

15. Apparatus according to claim 14 for closing and seaming an edge opening of a cover, further comprising said guide having outer fingers on opposite side of the gas discharging finger, said outer fingers being angled apart to a separation greater than the cross-section suited to exceed the cover panels edge opening, and said outer fingers being extended from narrowed separations from the gas discharging finger to being substantially parallel thereto and to one another and defining narrow channels therebetween suited to contain and hold the panels and in-folder flaps generally snugged together suited for being stitched together as the seam.

16. Apparatus according to claim 15 for closing and seaming an edge opening of a cover, further comprising means for supporting the sewing machine to move along the edge opening of the cover panels, means supporting the guide relative to the sewing machine and on the upstream side thereof operable for moving simultaneously therewith relative to and along the folded and tensioned panel edges prior to the stitching for the final seam.

17. Apparatus according to claim 16 for closing and seaming an edge opening of a cover, further comprising means for shifting the guide fingers transverse to the tensioned panel edges to align said edges substantially with or slightly below the base of the sewing machine base prior to stitching.

18. Apparatus according to claim 16 for closing and seaming an edge opening of a cover, further comprising means for moving the support members in the direction of the visually apparent edge opening to remove the members from between the tensioned cover panels and in-turned flaps just prior to the sewing machine completing the final seam.

* * * * *